US010608394B2

(12) United States Patent
Cusick

(10) Patent No.: US 10,608,394 B2
(45) Date of Patent: Mar. 31, 2020

(54) ASSEMBLIES AND METHODS FOR DETACHABLY SECURING AN ELECTRICAL DEVICE TO A SUPPORT SURFACE

(71) Applicant: Q6 IP PTY LTD, Victoria (AU)

(72) Inventor: Adam John Cusick, Victoria (AU)

(73) Assignee: Q6 IP PTY LTD, Vermont, Victoria (AU)

( * ) Notice: Subject to any disclaimer, the term of this patent is extended or adjusted under 35 U.S.C. 154(b) by 0 days.

(21) Appl. No.: 16/342,094

(22) PCT Filed: Oct. 23, 2017

(86) PCT No.: PCT/AU2017/051158

§ 371 (c)(1),
(2) Date: Apr. 15, 2019

(87) PCT Pub. No.: WO2018/076045

PCT Pub. Date: May 3, 2018

(65) Prior Publication Data

US 2019/0252838 A1 Aug. 15, 2019

(30) Foreign Application Priority Data

Oct. 25, 2016 (AU) ..... 2016904333

(51) Int. Cl.
*H01R 13/625* (2006.01)
*H01R 33/20* (2006.01)
(Continued)

(52) U.S. Cl.
CPC ..... *H01R 33/20* (2013.01); *H01R 13/625* (2013.01); *H01R 13/6205* (2013.01);
(Continued)

(58) Field of Classification Search
CPC ..... H01R 13/625; H01R 13/62905
See application file for complete search history.

(56) References Cited

U.S. PATENT DOCUMENTS 5,015,194 A * 5/1991 Seas ..... H01R 13/625 439/314
5,662,488 A * 9/1997 Alden ..... H01R 13/625 439/314
(Continued)

*Primary Examiner* — Tho D Ta
(74) *Attorney, Agent, or Firm* — Brooks Kushman P.C.

(57) ABSTRACT

An assembly detachably securing an electrical device to a support surface includes a support socket, a first coaxial electrical connector slidable within the support socket via a biasing element, a fitting module connectable to the electrical device has a second co-axial electrical connector for connection with the first coaxial electrical connector. An internal wall of the support socket includes projections, each defining a camming surface and a retaining recess; an external wall of the fitting module comprises externally projecting lugs. The fitting module is secured into the support socket by pushing in the axial direction against the biasing element, such that a lug is directed along a camming surface to thereby move itself or another lug between two projections to enter a retaining recess. The fitting module is released from the support socket by pushing in the axial direction against the biasing element.

19 Claims, 7 Drawing Sheets

(51) Int. Cl.

| | |
|---|---|
| ***H01R 13/629*** | (2006.01) |
| ***H01R 31/06*** | (2006.01) |
| ***H01R 13/62*** | (2006.01) |
| ***H01R 13/66*** | (2006.01) |
| ***H01R 13/72*** | (2006.01) |
| ***H01R 13/74*** | (2006.01) |
| *H01R 24/00* | (2011.01) |
| *H01R 24/38* | (2011.01) |

(52) U.S. Cl.

CPC ..... *H01R 13/629* (2013.01); *H01R 13/62905* (2013.01); *H01R 13/6683* (2013.01); *H01R 13/6691* (2013.01); *H01R 13/72* (2013.01); *H01R 13/74* (2013.01); *H01R 31/06* (2013.01); *H01R 24/005* (2013.01); *H01R 24/38* (2013.01)

(56) References Cited

U.S. PATENT DOCUMENTS

| | | | | |
|---|---|---|---|---|
| 6,685,493 | B2 * | 2/2004 | Birkenmaier ..... | H01R 13/625 439/314 |
| 7,081,001 | B1 * | 7/2006 | Conroy ..... | H01R 13/625 439/314 |
| 7,740,499 | B1 * | 6/2010 | Willey ..... | H01R 13/625 439/332 |
| 8,267,710 | B2 * | 9/2012 | Pfeiffer ..... | H01R 13/625 439/140 |
| 9,362,672 | B1 * | 6/2016 | Sun ..... | H01R 13/639 |

* cited by examiner

ASSEMBLIES AND METHODS FOR DETACHABLY SECURING AN ELECTRICAL DEVICE TO A SUPPORT SURFACE

CROSS-REFERENCE TO RELATED APPLICATION

This application is the U.S. national phase of PCT Application No. PCT/AU2017/051158 filed on Oct. 23, 2017, which claims priority to AU Patent Application No. 2016904333 filed on Oct. 25, 2016, the disclosures of which are incorporated in their entirety by reference herein.

FIELD

The present invention relates to apparatus, assemblies and methods for detachably securing an electrical device to a support surface.

BACKGROUND

Along with many existing homes, thousands of new homes are constructed each year, each fitted with dozens of conventional light fittings. Those buying new homes are typically limited to only a few light fitting choices from the developers to simplify logistics and take advantage of bulk purchases. This is not ideal for those who may want to personalise their property with their own choice of lights.

If a homeowner wants to replace one or more light fittings, the process is time consuming, costly and requires a qualified electrician. Additionally, since the light fittings have already been hard wired to mains power and mechanically installed, the undesired light fitting will typically not be able to be returned for a refund or exchange.

In other applications such as at function venues (eg wedding venues, temporary event venues, etc), in shopfront windows, and on stage or film sets, conventional light fittings are changed regularly also using costly and time consuming processes to meet customer preference or set requirements.

In this context, there is a need for apparatus, assemblies, and methods for detachably securing an electrical device to a support surface, which allow for safe, quick and easy replacement of the electrical device.

SUMMARY

According to the present invention, there is provided an assembly for detachably securing an electrical device to a support surface, comprising:

a support socket mountable to the support surface;

a first co-axial electrical connector attached to and axially slidable within the support socket via a biasing element; and a fitting module connectable to the electrical device, and having a second co-axial electrical connector for orientation-independent connection with the first co-axial electrical connector, wherein the biasing element is configured to provide a force against insertion of the fitting module into the support socket, wherein an internal wall of the support socket comprises a row of projections spaced apart from each other, each projection defining a camming surface and a retaining recess, and an external wall of the fitting module comprises at least two sets of externally projecting lugs, each set comprising a retaining lug and two spaced apart guiding lugs, or vice versa, wherein the fitting module is secured into the support socket in any rotational orientation by pushing in the axial direction against the biasing element, such that a lug of each set of lugs is directed along a camming surface to thereby move itself or another lug between two projections to enter into a retaining recess, and wherein the fitting module is released from the support socket by pushing in the axial direction against the biasing element, such that a lug of each set of lugs is directed along a camming surface and a lug within a retaining recess is moved out of the retaining recess to exit between two projections.

In one embodiment, the two spaced apart guiding lugs, of each set of lugs, comprise a first guiding lug and a second guiding lug. Upon the axial push to secure the fitting module to the support socket, the retaining lug is directed along the camming surface of a first projection to enter between the first projection and an adjacent second projection, and the first guiding lug is directed along the camming surface of the second projection to rotate the retaining lug sideways into position above the retaining recess of the second projection, such that upon release of the axial push, the retaining lug is biased into the retaining recess.

Preferably, the first and second guiding lugs are arranged such that the first guiding lug is directed along the camming surface of the second projection until the second guiding lug abuts the second projection. This arrangement limits further sideways movement of the retaining lug when it reaches the position above the retaining recess.

In one embodiment, upon the axial push to release the fitting module from the support socket, the second guiding lug is directed along the camming surface of the second projection such that the retaining lug is moved out of the retaining recess and rotated sideways into position above a space between the second projection and an adjacent third projection, such that upon release of the axial push, the retaining lug is biased to exit between the second and third projections.

Preferably, the first and second guiding lugs are arranged such that the second guiding lug is directed along the camming surface of the second projection until the first guiding lug abuts the third projection. This arrangement limits further sideways movement of the retaining lug when it reaches the position above the space between the second projection and the adjacent third projection.

Each projection may further define second and third camming surfaces, one on each side of the retaining recess.

The second camming surface may guide the retaining lug into the retaining recess.

The third camming surface may guide the retaining lug to exit between two projections.

The projections may be integrally moulded in the support socket or to the fitting module.

The electrical device may be a pendant light, a recessed light, a downlight, a chandelier, a flush mounted light, or other light fitting.

The support surface may be a ceiling panel, and the support socket may further comprise retention elements configured for flush mounting the support socket to the ceiling panel. The support surface may be a wall panel or other support structure.

The fitting module may further comprise an internal storage compartment for storing an unused length of cable connecting the electrical device to the fitting module.

The fitting module may further comprise a cable retention mechanism for retaining the unused length of cable in the storage compartment.

The first and second co-axial connectors may be magnetically attracted to each other.

The assembly may further comprise a detachable cover to close the support socket when the fitting module is not inserted.

The assembly may further comprise a communication module for wirelessly receiving and/or transmitting data associated with control of the electrical device.

The assembly may further comprise one or more sensors, wherein sensed data is used to control operation of the electrical fitting.

The assembly may be assembled and mounted on a ceiling panel, wherein the support socket is electrically connected to mains power, and wherein the fitting module is electrically connected to a light fitting.

In a further aspect of the present invention, there is provided a kit of parts comprising the assembly described, further comprising a light fitting connected to the fitting module.

In a further aspect of the present invention, there is provided a method of detachably installing an electrical device to a support surface using the assembly described, the method comprising:

mounting the support socket onto the support surface;

electrically connecting the first co-axial connector to mains power;

electrically connecting the electrical device to the fitting module; and securing the fitting module into the support socket by pushing in the axial direction against the biasing element, such that a lug of each set of lugs is directed along a camming surface to thereby move itself or another lug between two projections to enter into a retaining recess.

In a further aspect of the present invention, there is provided a method of replacing the electrical device installed using the method described, the method comprising:

releasing the fitting module from the support socket by pushing in the axial direction against the biasing element, such that a lug of each set of lugs is directed along a camming surface and a lug within a retaining recess is moved out of the retaining recess to exit between two projections;

providing a replacement electrical device connected to a replacement fitting module; and securing the replacement fitting module into the support socket by pushing in the axial direction against the biasing element, such that a lug of each set of lugs is directed along a camming surface and between two projections to enter into a retaining recess.

BRIEF DESCRIPTION OF DRAWINGS

Embodiments of the invention will now be described by way of example only with reference to the accompanying drawings, in which.

DESCRIPTION OF EMBODIMENTS

Figure 1:
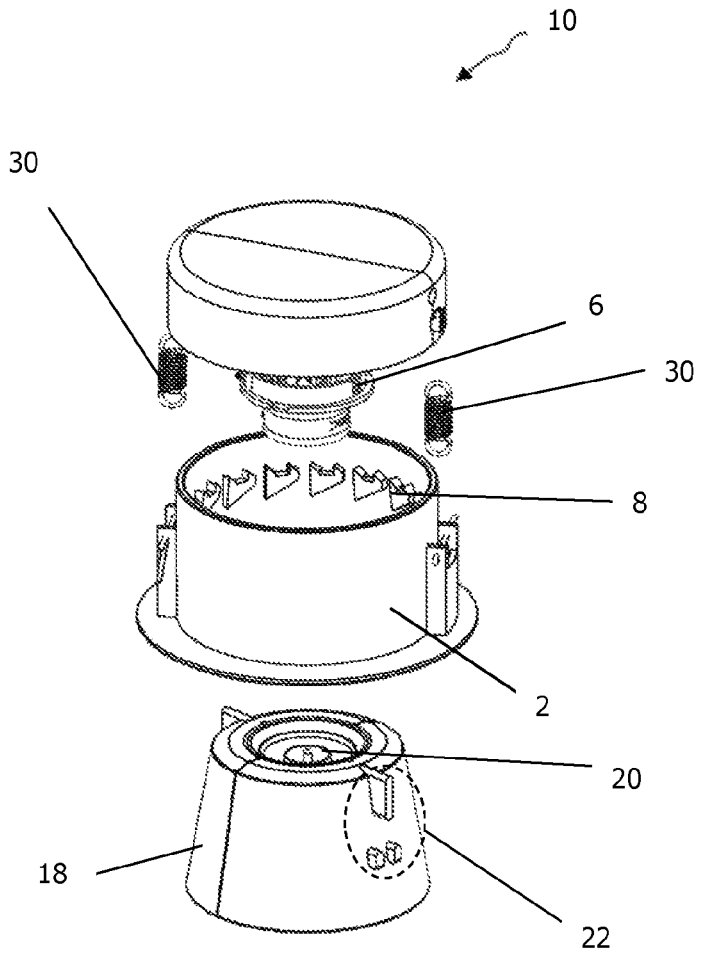
FIG. 1 is an exploded perspective view of the assembly for detachably securing an electrical device to a support surface according to an embodiment.

Referring to the drawings, an assembly 10 for detachably securing an electrical device to a support surface 4 according to an embodiment of the invention comprises a support socket 2 mountable to the support surface 4, and a fitting module 18 electrically connected to the electrical device. The support socket 2 has a row of projections 8 spaced apart from each other along an internal wall of the socket. Each projection defines a first (bottom) camming surface 9 and an upwardly-opening retaining recess 16. A first co-axial electrical connector 6 is attached to the support socket 2 via a biasing element 30, in the form of a tension spring in the embodiment shown, so as to be axially slidable within the support socket 2. This biased arrangement is configured to provide a force against insertion of the fitting module 18 into the support socket 2. Although a tension spring is used in the embodiment shown in the drawings, other embodiments may comprise compression springs, torsion springs, leaf springs, rubber/elastomer bands of standard or custom shape, or, when the assembly is used vertically, simply gravity providing the force.

To prevent rotation of the first co-axial electrical connector 6 relative to the support socket 2, a pair of guide rails (not shown) or other similar guide configuration may be provided between the first co-axial electrical connector 6 and the support socket 2.

The fitting module 18 has a second co-axial electrical connector 20 for orientation-independent connection with the first co-axial electrical connector 6. The co-axial electrical connectors 6, 20 may additionally be magnetically attracted to each other to further facilitate connection. At least two sets of externally projecting lugs 22 are provided on the fitting module 18, configured to engage with the projections 8 of the support socket 2. Each set of lugs 22 preferably comprises an upper retaining lug 24 and two spaced apart lower guiding lugs 26, 28. The width of and spacing between the lugs 24, 26, 28 is configured such that one guiding lug is directed along a camming surface 9 until the other lug abuts with a projection 8 to limit camming movement of the retaining lug, as will be described below with reference to FIGS. 5 to 8. Alternative or equivalent configurations may be provided, for example the lower lugs may instead comprise a unitary lug (eg a U-shaped lug having two spaced-apart upper extensions). The two sets of lugs 22 are preferably positioned substantially diametrically opposite each other on the fitting module 18 for increased security and stability of the fitting module when inserted in the support socket 2. In an alternative embodiment (now shown), three or more sets of lugs may instead be provided for even greater security and stability. In an embodiment having three sets of lugs, the three sets would preferably be equally spaced, 120 degrees apart, around the periphery of the fitting module 18.

Because the row of projections 8 extends around the entire inner circumference of the support socket 2, the fitting module 18 is securable into the support socket 2 in any rotational orientation, ie the user simply pushes the fitting module 18 into support socket 2 in the axial direction against the biasing force of the biasing element 30. If the fitting module 18 is not inserted such that lugs 24 directly enter between two projections, the camming surfaces 9 of the projections 8 guide the lugs into this position. Accordingly, regardless of the rotational orientation of the fitting module 18 relative to the support socket 2, the lugs 24 are directed into a retaining recess 16 of a projection. This brings the first and second co-axial electrical connectors 6, 20 into contact with each other, such that the support socket 2 and fitting module 18 become electrically and mechanically connected to each other.

The fitting module 18 is released from the support socket 2 by simply pushing the fitting module 18 once again in the axial direction into support socket 2, against the biasing force of the biasing element 30. This directs the lugs 22 along a camming surface of a projection 8, and out of the retaining recess 16 to exit between two projections, thereby electrically and mechanically disconnecting the fitting module 18 from the support socket 2.

In other embodiments, the projections 8 may instead be provided along an external surface of the fitting module 18, and the lugs 22 may instead be provided on an internal wall of the support socket 2. It will be appreciated that in this case, some orientations will be reversed compared to the description above, eg the first camming surface 9 will be on an upper surface of each projection 8 on fitting module 18, but the retaining mechanism would still function in an equivalent manner. Alternatively, in further embodiments, the lugs 22 and/or projections 8 may be mounted on swivel or axially rotatable rings within the support socket 2 and/or fitting module 18.

In some embodiments as shown in FIGS. 5 and 6, each projection may also comprise second and third (upper) camming surfaces 12, 14, one on each side of the retaining recess 16. The projections 8 are spaced apart from each other by a distance at least equivalent to the width of retaining lug 24, but preferably wider to ensure the lug 24 can easily pass between two adjacent projections.

Figure 5A:
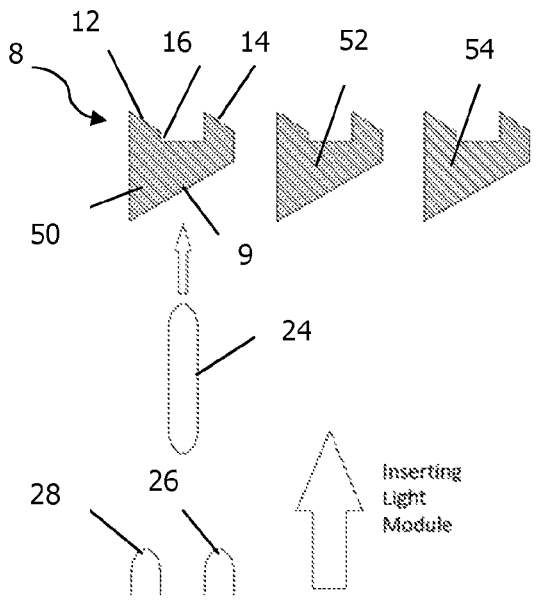
FIGS. 5*a* to 5*g* schematically illustrate the sequence of inserting the fitting module to the support socket according to an embodiment.
Figure 5B:
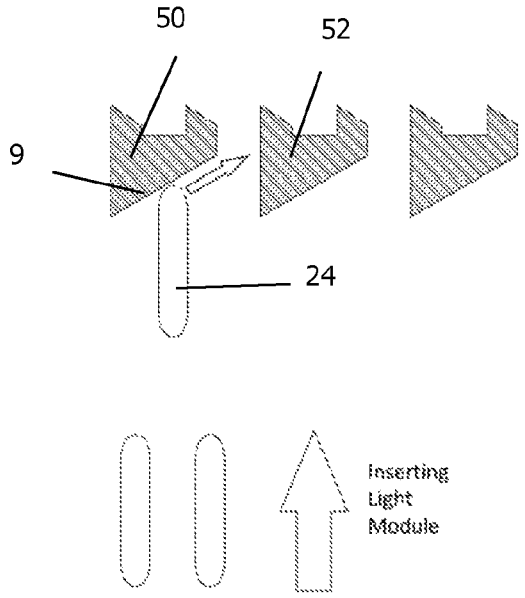
Figure 5C:
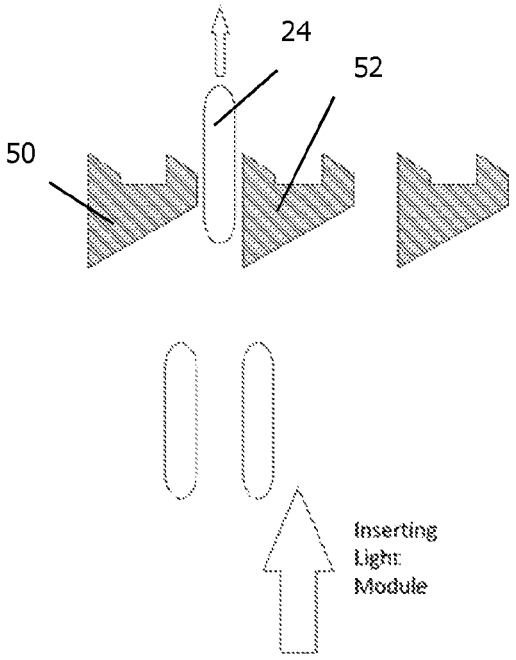
Figure 5D:
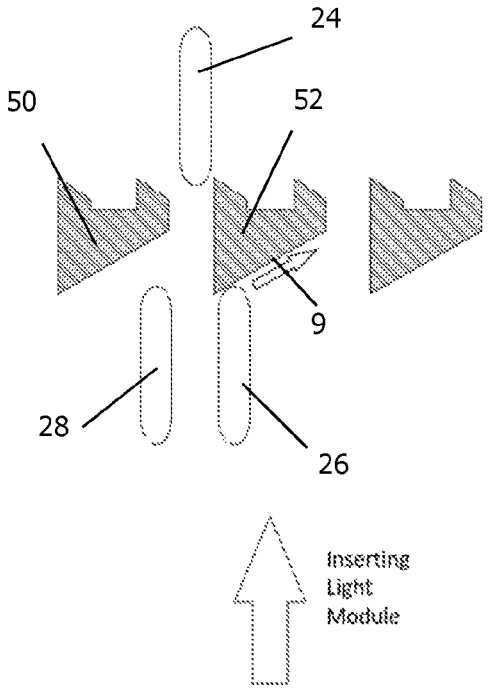
Figure 5E:
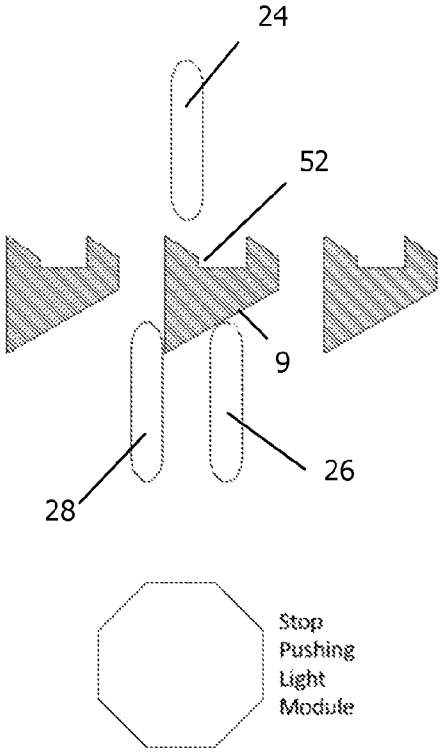
Figure 5F:
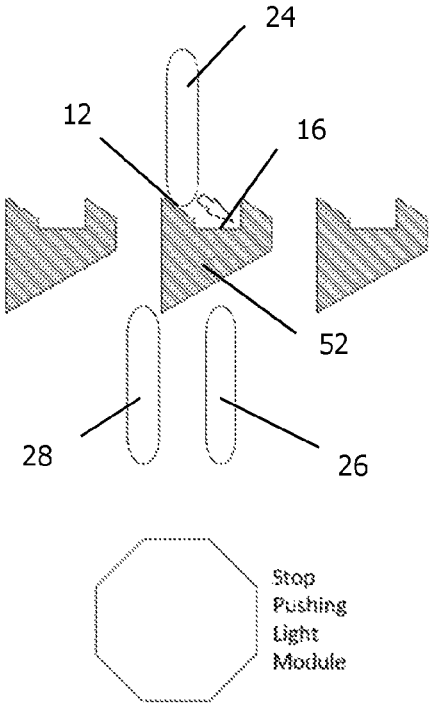
Figure 5G:
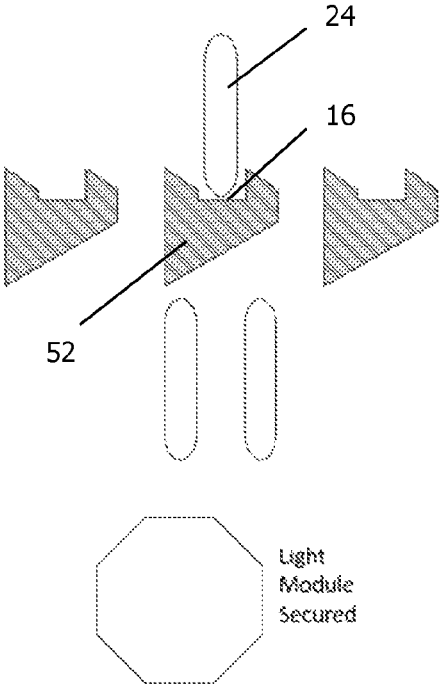

FIGS. 5*a* to 5*g* schematically illustrate the sequence of engagement of lugs 24, 26, 28 with a section of the row of projections (comprising three projections 50, 52 and 54), according to one embodiment. As the fitting module 18 is pushed axially into the support socket 2 (FIG. 5*a*), the retaining lug 24 is directed upwards and along the bottom camming surface 9 of first projection 50 (FIG. 5*b*) to enter between the first projection 50 and the adjacent second projection 52 (FIG. 5*c*). At some stage of this movement, the first guiding lug 26 starts to engage with the bottom camming surface 9 of the second projection 52, thereby moving the retaining lug 24 upwards while rotating it sideways towards the retaining recess 16 of the second projection 52 (FIG. 5*d*). The second guiding lug 28 eventually comes into contact with the side of the second projection 52, limiting any further camming or axial movement (FIG. 5*e*). The user may then release the axial force on the fitting module 18. The retaining lug 24 will then be directed under the force of the biasing element 30 along the second upper camming surface 12 of the second projection 52 to enter into the retaining recess 16 of the second projection 52 (FIG. 5*f*). The fitting module 18 is thereby secured to the support socket 2 (FIG. 5*g*). In some embodiments, the support socket 2 and/or fitting module 18 may further comprise spring arrangements or other resilient elements (not shown) to provide audible and/or tactile feedback indicating to the user when the push action is complete.

Figure 6A:
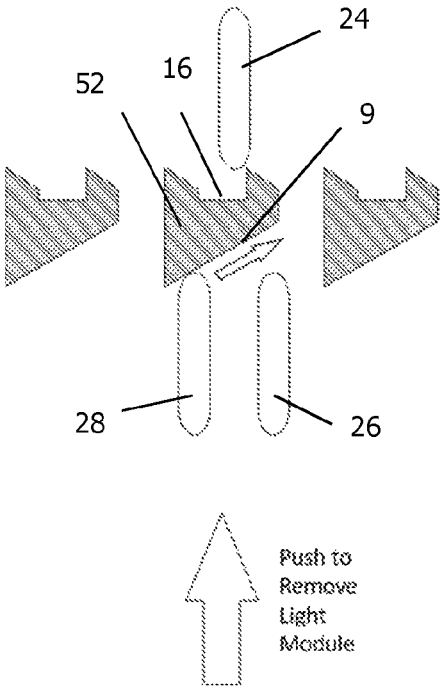
FIGS. 6*a* to 6*d* schematically illustrate the sequence of removing the fitting module from the support socket according to an embodiment.
Figure 6B:
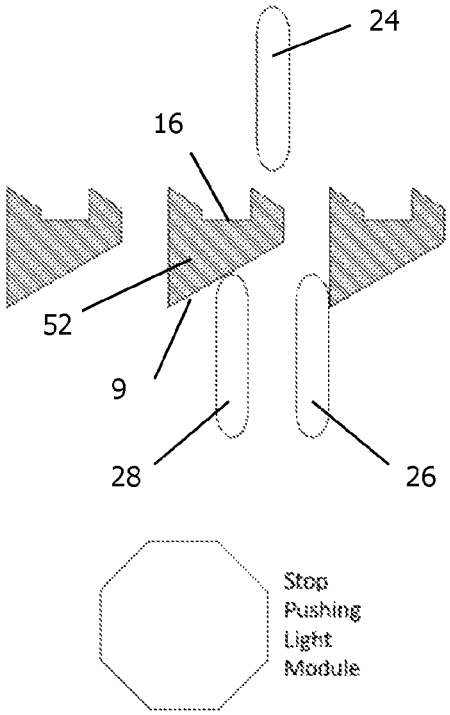
Figure 6C:
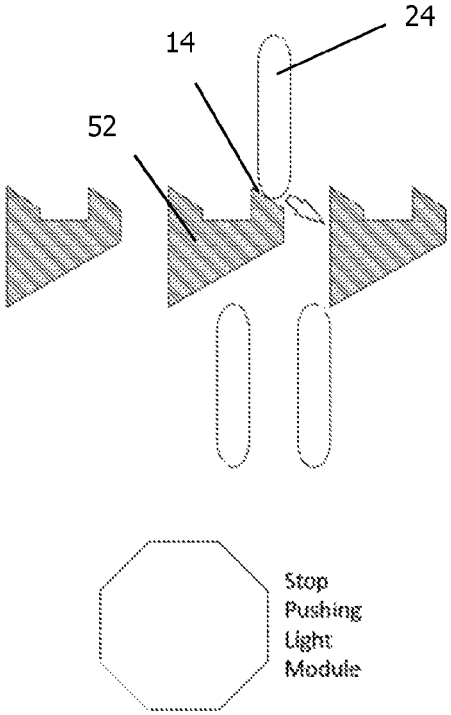
Figure 6D:
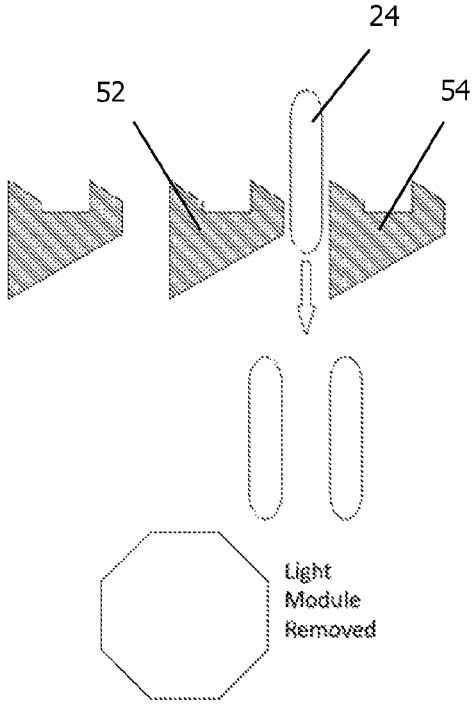

FIGS. 6*a* to 6*d* schematically illustrate the sequence of releasing the lug 24 from the retaining recess 16. As the user axially pushes the fitting module 18 into the support socket 2, the second guiding lug 28 is directed along the bottom camming surface 9 of the second projection 52 such that the retaining lug 24 is moved both upwardly and sideways out of the retaining recess 16 (FIG. 6*a*). The first guiding lug 26 eventually comes into contact with the side of the third projection 54, limiting any further camming or axial movement (FIG. 6*b*). The user may then release the axial force on the fitting module 18, and the retaining lug 24 will be directed under the force of the biasing element 30 along the third upper camming surface 14 of the second projection 52 to exit downwardly between the second projection 52 and third projection 54 (FIGS. 6*c*, 6*d*). The fitting module 18 may then be removed from the support socket 2.

In an alternative configuration, projections 8 need not have second and third (upper) camming surfaces 12, 14. The lugs 24, 26, 28 are spaced from each other such that after insertion, when the user releases the axial force on the fitting module 18, the retaining lug 24 will be biased directly downwards into the retaining recess 16. To detach the fitting module, when the user releases the axial force on the fitting module after the retaining lug 24 has been directed upwardly and sideways out of the retaining recess 16, the retaining lug 24 may be biased directly downwards to exit between the projections 52, 54.

The support socket 2 and fitting module 18 may be moulded of a suitable polymer, and the projections 8 and lugs 22 may be integrally moulded with the support socket 2 and fitting module 18 respectively. In other embodiments, the support socket 2 and fitting module 18 may be manufactured from a ceramic or metallic material.

The support socket 2 may further comprise retention features (not shown) for detachably mounting the socket to the support surface. Examples of retention features include spring loaded clips which are deployed and locked into place after pushing the support socket 2 through a hole in a ceiling panel, screwed-on bracket mounts, etc. The support socket 2 is electrically connected to mains power in use, ie hard wired or plugged into a general purpose outlet (GPO). Once the support socket 2 has been installed by an electrician, there is no need to hire an electrician for any future installation or replacement of the electrical device. Further, the user does not need any tools to replace the electrical device. The simple push-in, push-out mechanism is especially convenient when installing into or removing from a ceiling or a location that is difficult to access.

The co-axial connectors 6, 20 comprise live, neutral and earth terminals, and provide a touch-safe connection, even with an open support socket 2 and the power switched on, as there is no finger access to live components. The support socket 2 may further include a transformer to allow for the use of low voltage electrical devices, such as 12V halogen downlights.

The electrical device may be a ceiling light, such as a pendant light, a recessed light, a downlight, a chandelier, a flush mounted light, or other light fitting, to be removably mounted to a ceiling panel. The support surface 4 may alternatively be a wall and the electrical device may be a wall sconce. In other embodiments, the electrical device may be a fan, exhaust unit, smoke alarm, projector, security camera, modem, router, wireless connectivity range extender, speaker, etc. In yet other embodiments, the electrical device may be a GPO, or an extension socket connectable to mains power when the fitting module 18 is attached to the support socket 2. The assembly 10 may thereby function as a recessed ceiling or wall mounted GPO with retention features.

Figure 2:
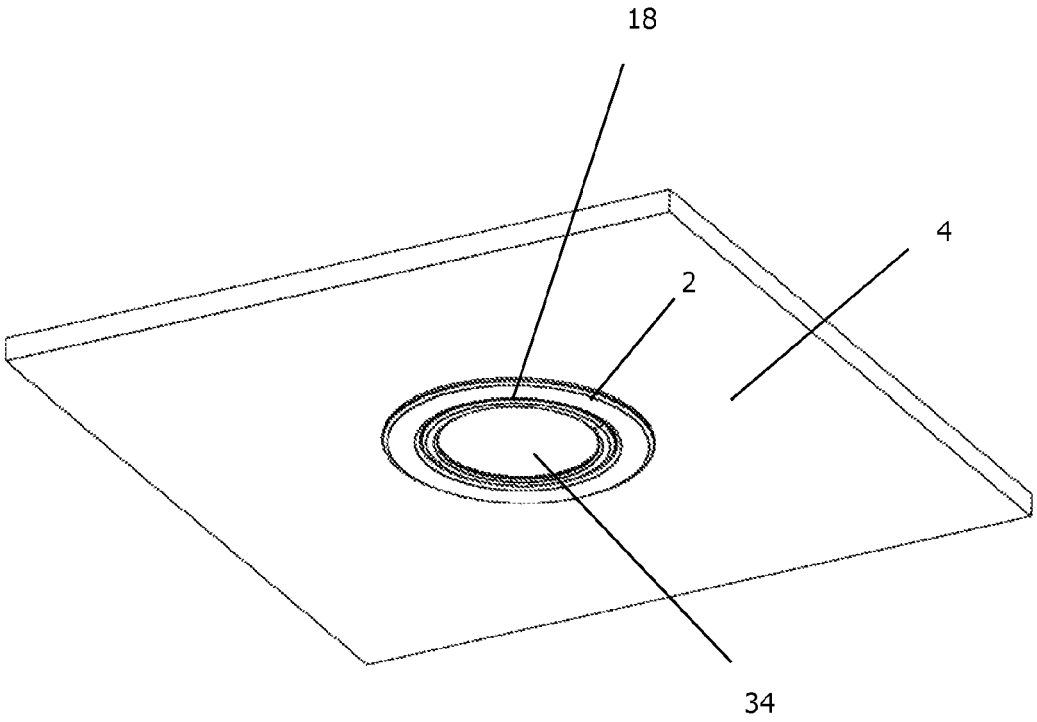
FIG. 2 is a bottom perspective view of a downlight secured to a ceiling panel using the assembly.

FIGS. 1 and 2 show an assembly 10 for installing a downlight or recessed light 34. The support socket 2 (and therefore the entire light fitting) is mountable flush against the ceiling to provide a clean, low-profile aesthetic. Additionally, the support socket 2 may be sized to fit into standard ceiling holes provided for conventional downlight installation.

Figure 3A:
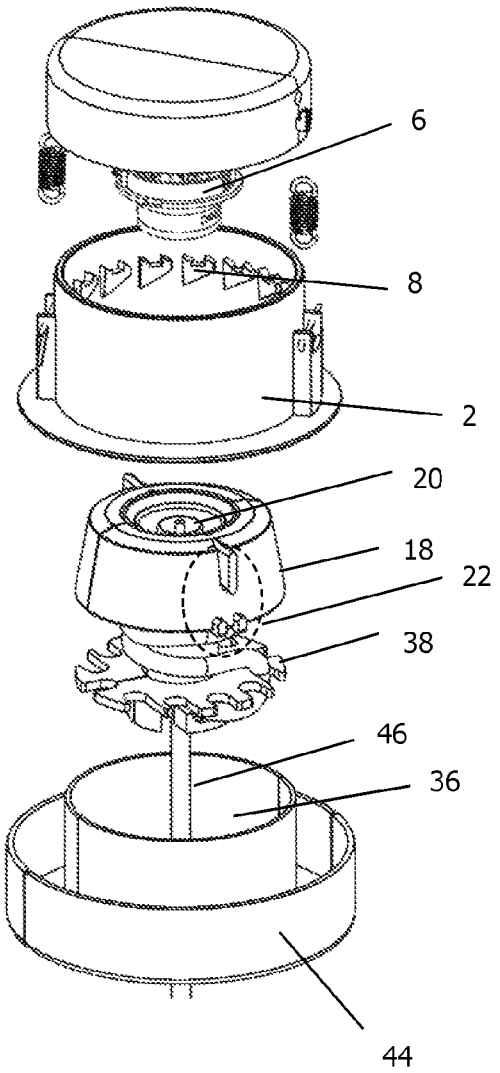
FIG. 3*a* is an exploded perspective view of the assembly for detachably securing a pendant light to a support surface according to an embodiment.
Figure 3B:
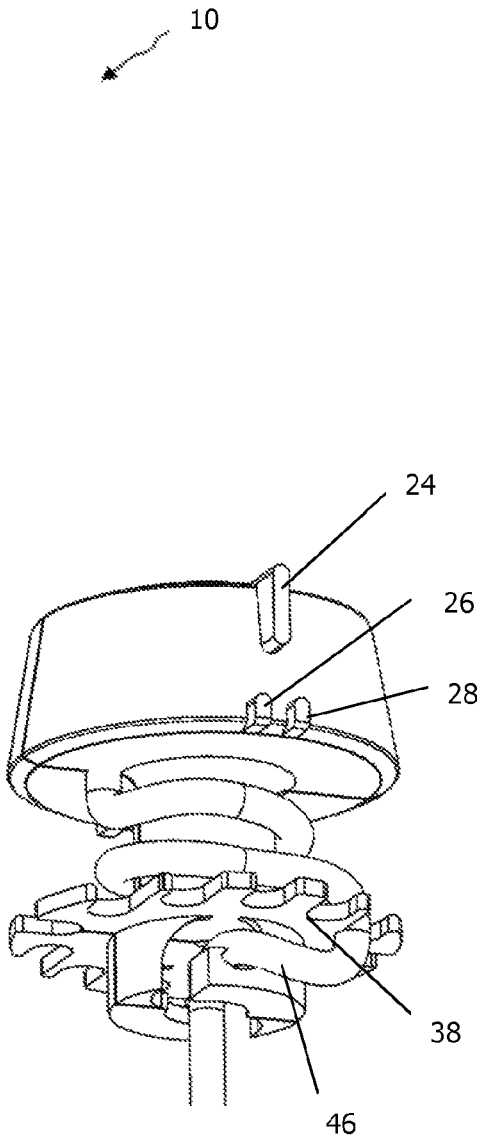
FIG. 3*b* is a close up perspective view of the pendant cable retention element of the assembly according to an embodiment.
Figure 4:
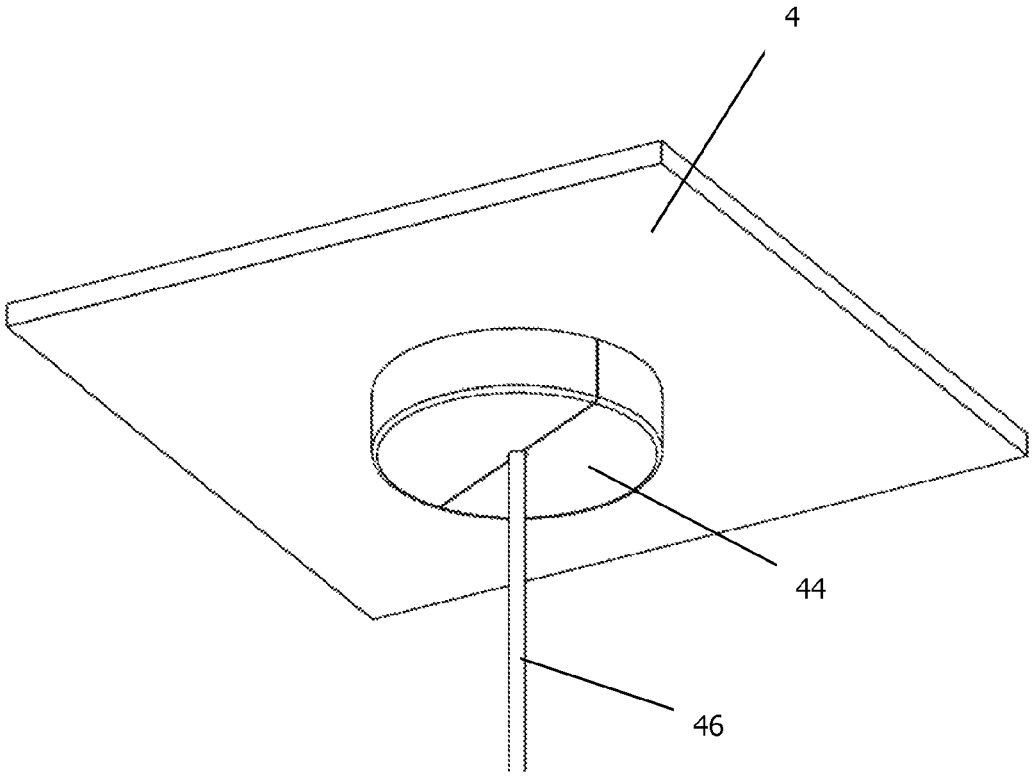
FIG. 4 is a bottom perspective view of a pendant light secured to a ceiling panel using the assembly.

FIGS. 3 and 4 illustrate an assembly 10 for installing a pendant light or a cluster of pendant lights. The fitting module 18 may further comprise a pendant canopy 44 mountable to the ceiling panel (via the support socket 2) to conceal the support socket 2, other components of the fitting module 18 and any unused length of cable 46. Accordingly, the fitting module 18 may provide an internal cable storage compartment 36, such that there is no need to cut the cable to the required length during installation, to allow for the drop height of the pendant light to be readily re-adjusted in the future. FIG. 3*b* shows an optional cable locking or retention element 38 to neatly and securely wind up the length of extra cable for storage in the cable storage compartment 36, and additionally to support the weight of the pendant light. Alternative cable retention features 38 may be provided, eg a spring-loaded reel or self-tightening cams, to facilitate retraction of the cable into the cable storage compartment 36.

In some embodiments, the assembly 10 may further comprise a slimline cover (not shown) for covering the support socket 2 when the fitting module 18 is not inserted. To better conceal the support socket, the cover may be mountable flush against the support surface 4, and painted over if desired.

The support socket 2 and/or the fitting module 18 may additionally comprise a communication module (not shown) for wirelessly communicating with another device, eg a mobile device, a computer, or one or more other assemblies 10, to facilitate wireless control of the electrical device, eg switching on or off, adjusting the brightness or colour of a light fitting, etc. In other embodiments, the assembly 10 may additionally comprise one or more sensors, eg a light sensor, motion sensor, camera, etc., and the wireless communication module may transmit recorded sensor data to the other device and/or use the sensed data to control the electrical device.

The present invention may be provided as a kit of parts, comprising one or more pairs of support socket 2 and fitting module 18. The electrical device may be provided pre-connected to the fitting module 18. In one example, the user may be provided with a variety of light fittings, each connected to a fitting module 18. After installing the support socket 2, the user may quickly and easily try out different types of light fittings before deciding on a preferred style.

The present invention provides a method of detachably installing an electrical device to a support surface 4 by mounting the support socket 2 onto the support surface and electrically connecting the first co-axial connector 6 to mains power. The fitting module 18, pre-connected to the electrical device, may then be secured into the support socket 2 by pushing in the axial direction against the biasing element 30, such that the lugs 22 are directed along the camming surface 9 and between two projections 8 to enter into a retaining recess 16.

To replace the electrical device, the fitting module 18 is released from the support socket 2 by pushing in the axial direction against the biasing element 30, such that the lugs 22 are directed along the camming surface 9 and out of the retaining recess 16 to exit between two projections 8. A replacement electrical device connected to a replacement fitting module may then be installed by inserting into the support socket 2 as previously described.

Embodiments of the present invention provide apparatus, assemblies, and methods that are useful for detachably securing an electrical device to a support surface, which allow for safe, quick and easy replacement of the electrical device, without the need for tools. Additionally or alternatively, embodiments of the present invention allow for different light fittings to be quickly swapped depending on the occasion, and may therefore be particularly useful when installed at function venues, shopfront windows, or stage sets, to provide users with the ability to customise lighting features. Additionally or alternatively, embodiments of the present invention facilitate removal of electrical devices for safekeeping when painting or performing renovations on the property.

For the purpose of this specification, the word "comprising" means "including but not limited to", and the word "comprises" has a corresponding meaning.

It is to be understood that other specific arrangements of parts, example devices, systems, and environments may be used and structural and functional modifications may be made without departing from the scope of the present invention. Also, while the terms "upper", "lower", "top", "bottom", "upwards", "downwards", "side", "sideways" and the like may be used in this specification to describe various example features and elements of the invention, these terms are used herein as a matter of convenience; eg, based on the example orientations shown in the figures. Nothing in this specification should be construed as requiring a specific three dimensional orientation of structures in order to fall within the scope of this invention.

It should be understood that functionally equivalent variations of the illustrated embodiments may be possible, for example:

a) the projections 8 may either be provided on the support socket 2 or the fitting module 18, and lugs 22 may accordingly be provided on the other of the fitting module 18 or the support socket 2;

b) the components may be unitary or may comprise multiple parts, eg the lugs 22 and/or projections 8 may be mounted on swivel or axially rotatable rings within the support socket 2 and/or fitting module 18, the guiding lugs 26, 28 may be provided as a unitary lug with two upward projections, the biasing element may be integrally provided in the support socket 2 or on the fitting module 18, etc;

c) the shape of the components, eg the lugs 22 and projections 8, may vary from the illustrated examples;

d) there may be additional retaining lugs and/or guiding lugs separate from the sets of lugs 22; and e) the guiding lugs 26, 28 may be located separately from the retaining lug 24 such that the retaining lug 24 interacts with projections 8 in one location, and the guiding lugs 26, 28 interact with different projections 8 in another location, but the retaining mechanism would still function in an equivalent manner.

The above embodiments have been described by way of example only and modifications are possible within the scope of the claims that follow.

The invention claimed is:

1. An assembly for detachably securing an electrical device to a support surface, comprising:

a support socket mountable to the support surface;

a first co-axial electrical connector attached to and axially slidable within the support socket via a biasing element; and a fitting module connectable to the electrical device, and having a second co-axial electrical connector for orientation-independent connection with the first co-axial electrical connector, wherein the biasing element is configured to provide a force against insertion of the fitting module into the support socket, wherein an internal wall of the support socket comprises a row of projections spaced apart from each other, each projection defining a first camming surface and a retaining recess, and an external wall of the fitting module comprises at least two sets of externally projecting lugs, each set comprising a retaining lug and two spaced apart guiding lugs, or vice versa, wherein the fitting module is secured into the support socket in any rotational orientation by pushing in the axial direction against the biasing element, such that the retaining lug is directed along a camming surface to thereby move itself or another lug between two projections to enter into a retaining recess, and wherein the fitting module is released from the support socket by pushing in the axial direction against the biasing element, such that a lug the two spaced apart guiding lugs are directed along the first camming surface and a lug within the retaining recess is moved out of the retaining recess to exit between two projections.

2. The assembly of claim 1, wherein the two spaced apart guiding lugs, of each set of lugs, comprise a first guiding lug and a second guiding lug, and wherein upon the axial push to secure the fitting module to the support socket, the retaining lug is directed along the camming surface of a first projection of the row of projections to enter between the first projection and an adjacent second projection, and the first guiding lug is directed along the first camming surface of the second projection to rotate the retaining lug sideways into position above the retaining recess of the second projection, such that upon release of the axial push, the retaining lug is biased into the retaining recess.

3. The assembly of claim 2, wherein upon the axial push to release the fitting module from the support socket, the second guiding lug is directed along the first camming surface of the second projection such that the retaining lug is moved out of the retaining recess and rotated sideways into position above a space between the second projection and an adjacent third projection, such that upon release of the axial push, the retaining lug is biased to exit between the second and third projections.

4. The assembly of claim 1, wherein each projection further defines second and third camming surfaces, one on each side of the retaining recess.

5. The assembly of claim 4, wherein the second camming surface guides the retaining lug into the retaining recess.

6. The assembly of claim 4, wherein the third camming surface guides the retaining lug to exit between two projections.

7. The assembly of claim 1, wherein the projections are integrally moulded in the support socket or to the fitting module.

8. The assembly of claim 1, wherein the electrical device is a pendant light, a downlight, a chandelier, or a flush mounted light.

9. The assembly of claim 1, wherein the support surface is a ceiling panel, and the support socket further comprises retention elements configured for flush mounting the support socket to the ceiling panel.

10. The assembly of claim 1, wherein the fitting module further comprises an internal storage compartment for storing an unused length of cable connecting the electrical device to the fitting module.

11. The assembly of claim 10, wherein the fitting module further comprises a cable retention mechanism for retaining the unused length of cable in the storage compartment.

12. The assembly of claim 1, wherein the first and second co-axial connectors are magnetically attracted to each other.

13. The assembly of claim 1, further comprising a detachable cover to close the support socket when the fitting module is not inserted.

14. The assembly of claim 1 further comprising a communication module for wirelessly receiving and/or transmitting data associated with control of the electrical device.

15. The assembly of claim 1, further comprising one or more sensors, wherein sensed data is used to control operation of the electrical fitting.

16. The assembly of claim 1 assembled and mounted on a ceiling panel, wherein the support socket is electrically connected to mains power, and wherein the fitting module is electrically connected to a light fitting.

17. A kit of parts comprising the assembly of claim 1, further comprising a light fitting connected to the fitting module.

18. A method of detachably installing an electrical device to a support surface using the assembly of claim 1, comprising:

mounting the support socket onto the support surface, electrically connecting the first co-axial connector to mains power, electrically connecting the electrical device to the fitting module, securing the fitting module into the support socket by pushing in the axial direction against the biasing element, such that the retaining lug is directed along a first camming surface to thereby move itself or another lug between two projections to enter into a retaining recess.

19. A method of replacing the electrical device installed using the method of claim 18, comprising:

releasing the fitting module from the support socket by pushing in the axial direction against the biasing element, such that a lug of the two spaced apart guiding lugs is directed along a camming surface and the lug within the retaining recess is moved out of the retaining recess to exit between two projections, providing a replacement electrical device connected to a replacement fitting module, securing the replacement fitting module into the support socket by pushing in the axial direction against the biasing element, such that is the retaining lug directed along the camming surface and between two projections to enter into the retaining recess.

* * * * *